US012359459B2

(12) United States Patent
Jang

(10) Patent No.: US 12,359,459 B2
(45) Date of Patent: Jul. 15, 2025

(54) BOLLARD FENCE

(71) Applicant: Jeong Eun Jang, Seoul (KR)

(72) Inventor: Jeong Eun Jang, Seoul (KR)

( * ) Notice: Subject to any disclaimer, the term of this patent is extended or adjusted under 35 U.S.C. 154(b) by 368 days.

(21) Appl. No.: 18/131,910

(22) Filed: Apr. 7, 2023

(65) Prior Publication Data

US 2024/0183188 A1 Jun. 6, 2024

(30) Foreign Application Priority Data

Oct. 21, 2022 (KR) ..... 10-2022-0136906

(51) Int. Cl.

| | |
|---|---|
| ***E01F 13/02*** | (2006.01) |
| ***E04H 17/14*** | (2006.01) |
| ***F16L 21/06*** | (2006.01) |
| *E01F 15/14* | (2006.01) |

(52) U.S. Cl.

CPC ..... *E04H 17/1447* (2021.01); *E01F 13/02* (2013.01); *E01F 13/026* (2013.01); *E01F 15/14* (2013.01); *E04H 17/1417* (2013.01)

(58) Field of Classification Search

None

See application file for complete search history.

(56) References Cited

U.S. PATENT DOCUMENTS

| | | | | |
|---|---|---|---|---|
| D763,670 | S * | 8/2016 | Monsees | D8/382 |
| 9,638,365 | B1 * | 5/2017 | Reviel | F16B 5/0685 |
| 10,968,637 | B2 * | 4/2021 | Eves | E04F 11/1836 |
| 11,111,693 | B1 * | 9/2021 | Luk | E04H 17/1417 |
| D957,241 | S * | 7/2022 | Deng | D8/382 |
| 2010/0314597 | A1 * | 12/2010 | Rodriguez | E04H 17/1439 29/558 |
| 2015/0252941 | A1 * | 9/2015 | Sirkin | E04H 17/1417 248/219.4 |

FOREIGN PATENT DOCUMENTS

| | | | | |
|---|---|---|---|---|
| AT | 13089 | U1 * | 4/2013 | E01F 13/022 |
| CN | 201184023 | Y * | 1/2009 | |
| EP | 0658665 | A1 * | 12/1993 | |
| FR | 2973850 | A1 * | 10/2012 | E04H 17/1413 |
| GB | 2411910 | A * | 9/2005 | E04F 11/18 |
| GB | 2477555 | B * | 12/2011 | E04F 11/18 |
| JP | 5667006 | B2 * | 2/2015 | |
| KR | 100930510 | B1 * | 12/2009 | |

* cited by examiner

*Primary Examiner* — Phi D A

(74) *Attorney, Agent, or Firm* — IPLA P.A.

(57) ABSTRACT

A bollard fence that can be installed around a rack, the bollard fence includes: two ground fixing members; two vertical poles of which lower ends are installed in the open holes; L-connecting members having two perpendiculars coupling portions and having a fastening slope between the two coupling portions; a horizontal frame coupled between the L-connecting members; two-stage connectors having a vertical extension coupling groove; two sub-extension frames vertically coupled using the vertical extension coupling grooves; two L-couplers of which first ends are coupled to upper ends of the two sub-extension frames; and one horizontal frame.

2 Claims, 4 Drawing Sheets

BOLLARD FENCE

CROSS-REFERENCE

This application claims under 35 U.S.C. § 119(a) the benefit of Korean Patent Application No. 10-2022-0136906 filed on Oct. 21, 2022, the entire contents of which are incorporated herein by reference.

BACKGROUND

The present disclosure relates to a bollard fence, that is, a bollard fence that makes it possible to manufacture a sectional fence using one or more of a ground fixing member, a vertical pole, a horizontal frame, a swing connector, a sign, or various kinds of connecting members, couplers, and connectors.

In general, multilayer rack structures are installed with regular intervals in a warehouse, etc. to stack and keep articles in the unit of pallet as much as possible in a limited space, and workers move the articles stacked on the rack structures or stack articles using conveying machines such as an electrified industrial vehicle or a large cart. However, there is a problem that a safety accident that such conveying machines hit against rack structures, etc. occurs while keeping or conveying articles, so it has been required to develop an apparatus that can protect rack structures. In relation to this problem, in Korean Patent Application No. 10-2013-0030084, there has been proposed a rack post impact absorption device that includes: a shock absorbing member that is an elastic member, has an accommodation seat groove in which a rack post is accommodated, absorbs external shock, which is generated when the rack post collides, on the front and the sides, and distributes the external shock; and a fixing body that has an insertion hole in which the shock absorbing member is inserted, is made of a synthetic resin material or a metallic material so that the inserted shock absorbing member can be fixed to the rack post, and has a clip portion having predetermined elasticity. However, according to the rack post impact absorption device, it is required to additionally install a fence or a bollard around the rack post to prevent external shock itself. In Korean Patent Application No. 10-2014-0119148, there has been proposed a prefabricated shock absorbing bollard that includes: a shock absorber having several air pockets to be able to absorb shock that is transmitted from the outside; and a protection cover configured to be detachably attached to the outside of the shock absorber and preventing damage to the shock absorber, and to which a reflection plate can be attached so that the bollard can be recognized even at night. However, there is a defect that it is difficult to vertically or horizontally expand a fence.

Accordingly, the present disclosure intends to provide a bollard fence that makes it possible to manufacture a sectional fence that can be expanded using one or more of a ground fixing member, a vertical pole, a horizontal frame, a swing connector, or various kinds of connecting members, couplers, and connectors to be able to prevent approach collision around a multilayer rack structure.

SUMMARY OF THE INVENTION

The present disclosure relates to a bollard fence and an object of the present disclosure is to provide a bollard fence that makes it possible to assemble and manufacture various types of expandable fences to be able to safely protect racks.

In order to achieve the object, the present disclosure provides a bollard fence that can be installed around a rack.

The present disclosure is achieved by providing a bollard fence including: a ground fixing member, a vertical pole that is installed on the ground fixing member, a top cap that can be fitted in the upper end of the vertical pole, and a sign that can be held on the top cap.

Further, the present disclosure is achieved by providing a bollard fence including: two ground fixing members; swing connectors that can be installed on the ground fixing members, respectively; and a horizontal frame that is installed across the two swing connectors.

Further, the present disclosure is achieved by providing a bollard fence including: two ground fixing members; vertical poles that can be installed on the two ground fixing members; two swing connectors that can be fitted in the upper ends of the vertical poles; and a horizontal frame that is installed across the two swing connectors.

Further, the present disclosure is achieved by providing a bollard fence that can be formed in multiple stages and includes: a plurality of ground fixing members; a vertical pole that is installed on each of the ground fixing members; an L-connecting member that can be coupled to the top of the vertical pole; a horizontal frame that can be coupled to the L-connecting member or a horizontal connector; two-stage connector that can be coupled to the outer wall of the L-connecting member or the horizontal connector; a sub-extension frame that can be vertically coupled to the top of the two-stage connector; and a T-coupler or an L-coupler provided such that a sub-extension frame can be horizontally coupled between the vertically coupled sub-extension frames.

The present disclosure relates to a bollard fence and has an advantage that it is possible to simply expand and manufacture a sectional fence in various types using one or more of a ground fixing member, a vertical pole, a horizontal frame, a swing connector, or various kinds of connecting members, couplers, and connectors to be able to prevent approach collision around a multilayer rack structure.

DETAILED DESCRIPTION OF THE INVENTION

Hereafter, the present disclosure is described in detail with reference to the accompanying drawings.

The terms and words used in the present specification and claims should not be interpreted as being limited to typical meanings or dictionary definitions, but should be interpreted as having meanings and concepts relevant to the technical scope of the present disclosure based on the rule according to which an inventor can appropriately define the concept of the terms to describe most appropriately in the best possible way that he or she knows for carrying out the disclosure.

Accordingly, it should be appreciated that there may be various equivalents and modifications that can replace the embodiments and the configurations at the time at which the present application is filed.

The present disclosure relates to a bollard fence that can prevent approach collision around a multilayer rack structure.

Figure 1:
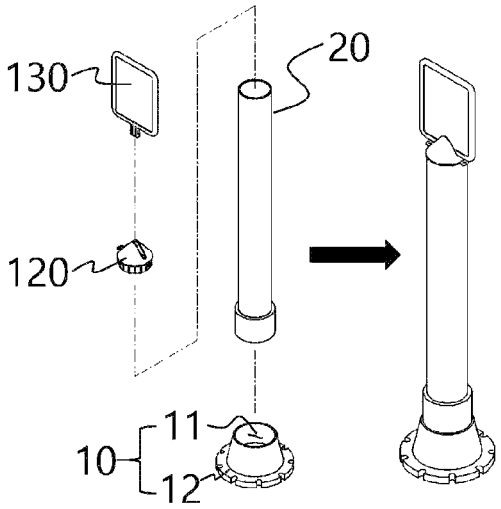
FIG. 1 is an exploded and assembled view of a sign that is installed on a bollard fence.
Figure 2:
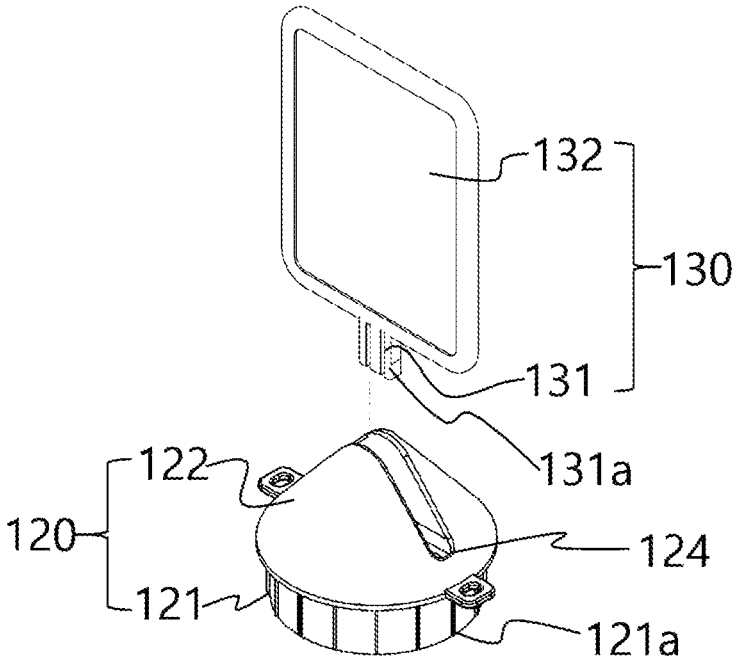
FIG. 2 is a detailed view of the sign that is installed on bollard fence.
Figure 3:
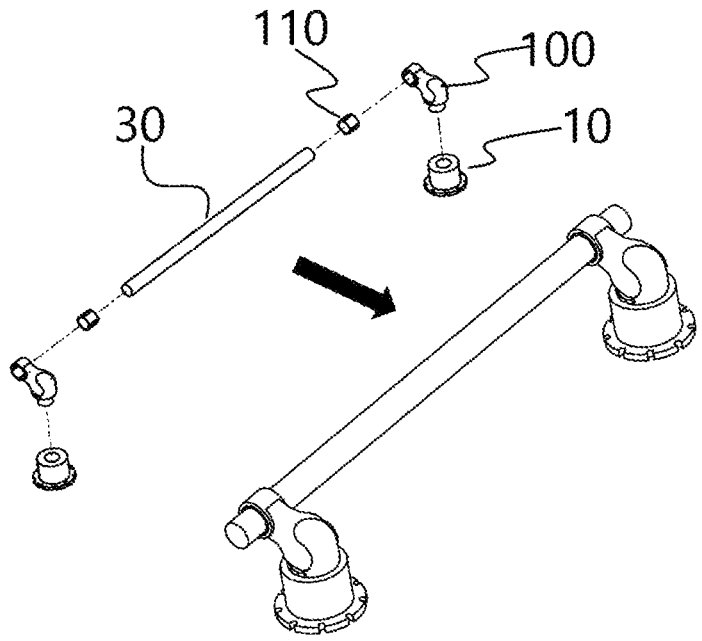
FIG. 3 is an exploded and assembled view of swing connectors that are installed on a ground fixing member of the bollard fence.
Figure 4:
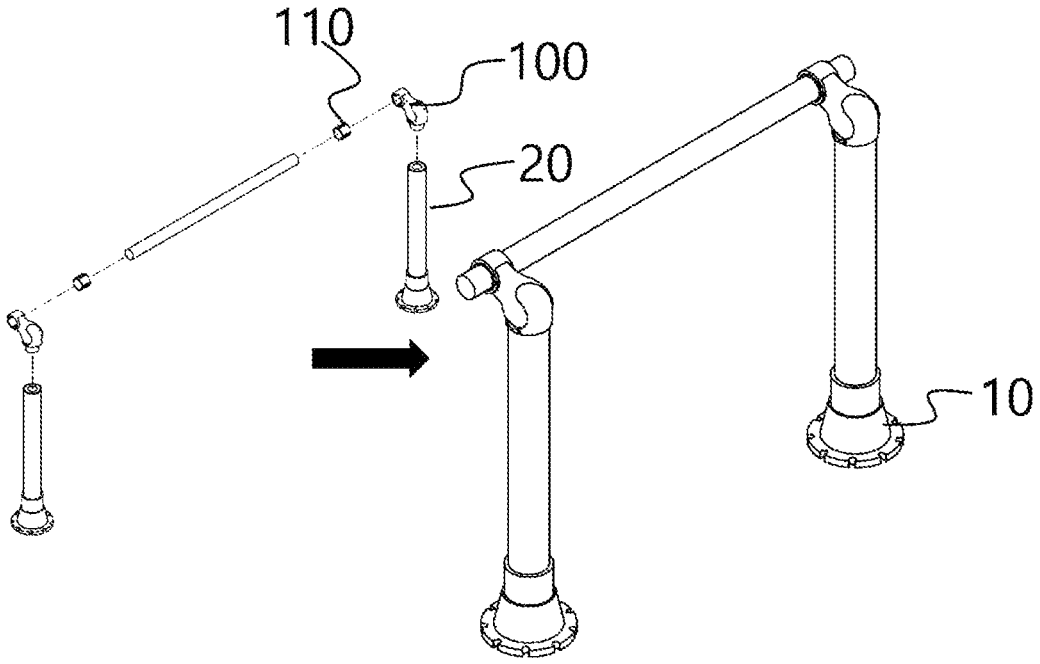
FIG. 4 is an exploded and assembled view of swing connectors that re installed on a vertical pole of the bollard fence.
Figure 5:
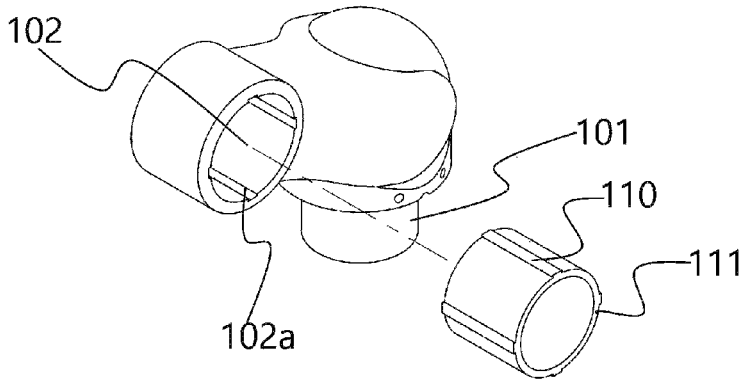
FIG. 5 is a detailed view of the swing connector of the bollard fence.

The bollard fencer, in a broad meaning, as shown in FIG. 1, may include: a ground fixing member 10; a vertical pole 20 that is installed on the ground fixing member; a top cap 120 that can be fitted in the upper end of the vertical pole; and a sign 130 that can be mounted on the top cap, or, as shown in FIG. 3, may include: two ground fixing members 10; swing connectors 100 that can be installed on the ground fixing members, respectively, and a horizontal frame 30 installed across the two swing connectors, or, as shown in FIG. 4, may include: two ground fixing members 10; vertical poles 20 that can be installed on the two ground fixing members; two swing connectors 100 that can be fitted in the upper ends of the vertical poles; and a horizontal frame 30 installed across the two swing connectors, or, as shown in FIGS. 6 to 9, may include: a plurality of ground fixing members 10; vertical poles 20 that are installed on the ground fixing members, respectively; L-connecting members 40 that can be coupled to the top of the vertical pole; horizontal frames 30 that can be coupled to the L-connecting member or a horizontal connecting member 50; two-stage connectors 80 that can be coupled to the outer wall of the L-connecting member or the outer wall of the horizontal connecting member 50; sub-extension frames 90 that can be perpendicularly coupled to the top of the two-stage connector; and a T-coupler 60 or an L-coupler 70 that is disposed between the vertically coupled sub-extension frames so that the sub-extension frames can be horizontally coupled. Accordingly, the bollard fence can be formed in multiple layers and can be horizontally extended.

In more detail, the ground fixing member 10 has: a ground supporting portion 12 enabling the bottom thereof to be installed and fixed on the ground: and an open groove 11 formed on the top thereof, so the vertical pole 20 or the swing connector 100 can be installed and inserted through the open groove on the top.

The vertical pole 20 is a hollow pillar type member and the lower portion thereof can be installed in the open groove 11 of the ground supporting portion.

The swing connector 100 is formed in a "ㄱ" shape having: a lower coupling portion 101; and an upper coupling ring 102 having a plurality of inner rail grooves 102*a* on the inner wall, the lower coupling portion 101 can be inserted in the open groove 11 of the ground fixing member or installed at the upper end of the vertical pole 20, ring adapters 110 having various inner diameters are coupled to the upper coupling ring 102, and the ring adapters 110 have a plurality of rails 111 on the outer wall thereof, so the swing counter 100 is manufactured such that ring adapters 110 having various inner diameters can be coupled to the inner rail grooves 102*a* of the upper coupling ring 102 in accordance with the thickness of the horizontal frame 30.

The sign 130 has: a fastening protrusion 131 having a locking portion 131*a* at the lower portion thereof; and an indication portion 132 at the upper portion thereof.

A conical top cap that can be fitted in the top of the vertical pole has: an insertion portion 121 having a friction protrusion 121*a* at the lower portion thereof; and an exposed portion 122 at the upper end thereof, and further has: a fastening hole (not shown) formed through the centers of the insertion portion and the exposed portion; and a coupling seat groove 124 formed across the fastening hole (not shown) of the exposed portion (not shown). The outer diameter of the insertion portion 121 is smaller than the inner diameter of the vertical pole, so the insertion portion can be inserted in the vertical pole 20. The fastening protrusion 131 formed at the lower portion of the indication portion of the sign 130 is inserted in the fastening hole and is fastened to the fastening hole 123 using the locking portion 131*a*, thereby being able to prevent the sign from separating from the fastening hole. The bottom of the indication portion is seated in the coupling seat groove 124.

A plurality of vertical poles 20 can be fitted in the plurality of ground fixing members 10 and a horizontal frame can be installed between the vertical poles 20 using the L-connecting member 40 or the horizontal connecting member 50. The L-connecting member 40 has: two coupling portions 51 perpendicularly formed such that vertical frames 20 at both ends of a fence and the horizontal frame 30 can be coupled; and a fastening slope 52 having a plurality of surface contact fastening portions 52*a* to contribute to fastening to an outer wall between the two coupling portions 51 using a fastener 140 such as a bolt.

A first end of the horizontal connecting member 50 may be coupled to a first end of a horizontal frame 30 at the center of a fence and a second end of the horizontal connecting member may be coupled in surface contact to the fastening slope 52 of the L-connecting member, whereby it is possible to extend the fence.

The two-stage connector 80 has: a vertical extension coupling groove 81 formed at the upper end thereof; and a fastening portion 82 formed at the lower portion thereof and having a fastening through-hole 82*a* formed to be able to be fastened to the fastening slope 52 on the outer wall of the L-connecting member 40. The fastening through-hole of the fastening portion and the surface contact fastening portion of the fastening slope can be coupled using the fastener 140, such as a bolt, with the fastening portion of the two-stage connector in surface contact with the fastening slope 52 of the L-connecting member, and the fastening portion 82 of the two-stage connector can be coupled to the outer wall of the horizontal connecting member coupled to the L-connecting member with the fastening slope of the L-connecting member fastened to the horizontal connecting member 50. The sub-extension frame 90 is vertically installed in the vertical extension coupling groove of the two-stage connector and the T-coupler 60 the L-coupler 70 is used between sub-extension frames vertically installed, whereby it is possible to extend a fence in a multistage type.

Three sub-extension frames can be fitted to the T-coupler 60 and two sub-extension frames can be fitted to the L-coupler 70.

As an embodiment, as shown in FIG. 1, the lower end of a vertical pole is coupled to the open groove 11 of a ground fixing member 10, a top cap 120 can be fitted in the upper end of the vertical pole using the insertion portion 121 of the top cap, and the friction protrusion 121*a* formed on the outer wall of the insertion portion can prevent the top cap 120 from separating from the vertical pole. The fastening protrusion 131 of a sign 130 can be fitted in the fastening hole (not shown) formed through the center of the top cap and the locking portion 131*a* is formed at the end of the fastening protrusion, whereby it is possible to prevent the sign from separating from the fastening hole (not shown). The bottom of the sign is seated and held in the coupling seat groove 124 formed at the exposed portion 122 of the top cap 120.

Further, a swing connector 100 can be installed in the open groove 11 of the ground fixing member, as shown in FIG. 3. Two swing connectors can be coupled to two ground fixing members, respectively, and a horizontal frame 30 is installed horizontally between the upper coupling rings 102 of the two swing connectors. In detail, the horizontal frame 30 may be installed after ring adapters are coupled to upper coupling rings 102, respectively, using the inner rail grooves 102*a* of the upper coupling rings 102 and the rails 111 of the ring adapters 110 in accordance with the thickness of the horizontal frame, and, as shown in FIGS. 3 and 4, the lower coupling portion 101 of the swing connector can be coupled not only to the ground fixing member 10, but to the upper end of the vertical pole 20, so it is possible to adjust the height of a fence in accordance with the length of the vertical frame.

Figure 6:
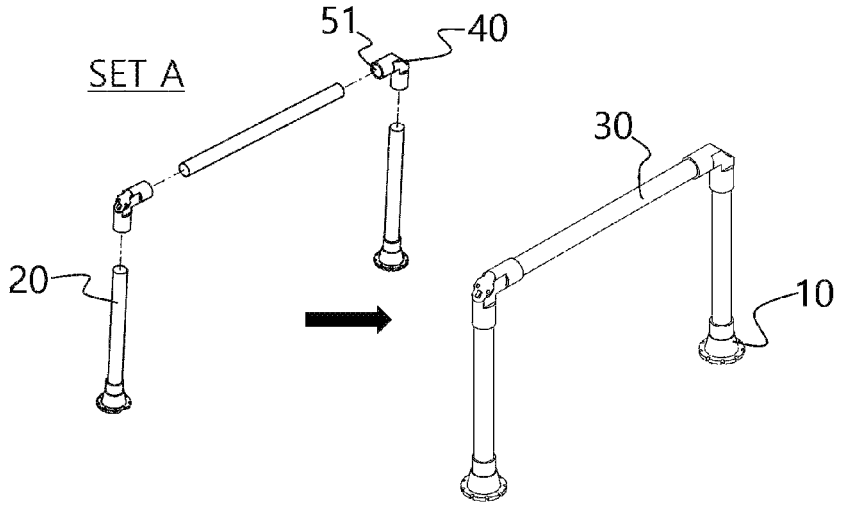
FIG. 6 is an exploded and assembled view of a set A of the bollard fence.

Further, as shown in FIG. 6, vertical poles can be coupled to the opening grooves of two ground fixing members, respectively, the first ends of L-connecting members 40 are coupled to the upper ends of the vertical poles, respectively, and a horizontal frame is installed between the second ends of the L-connecting members 40, whereby it is possible to assemble and manufacture a set of fences (set A).

Figure 8:
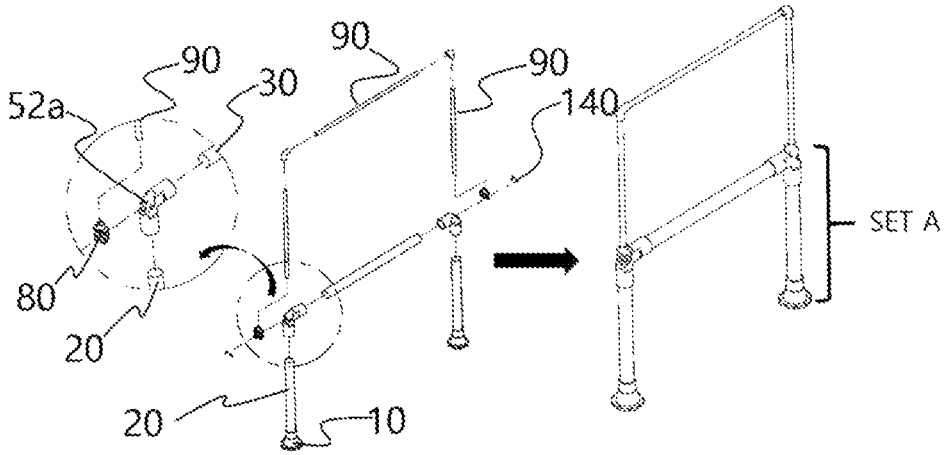
FIG. 8 is an embodiment view illustrating vertical extension of the set A of the bollard fence.

The one set of fences can be extended horizontally or vertically. As shown in FIG. 8, in order to vertically extend a set of fences (set A), two-stage connectors 80 having the vertical extension coupling groove 81 and the fastening portion 82 can be fastened respectively to the fastening slopes of the L-connecting members. In this case, the fastening portions of the two-stage connectors having the fastening through-hole 82*a* are coupled in surface contact with the surface contact slopes of the L-connecting members using fasteners 140, sub-extension frames 90 are vertically installed in the vertical extension coupling grooves 81 of the two-stage connectors, the first ends of the L-coupling members 70 are coupled to the upper ends of the vertically installed sub-extension frames, respectively, and one sub-extension frame is horizontally coupled to each of the second ends of the L-coupling members. Accordingly, it is possible to vertically extend the set of fences (set A).

Figure 7:
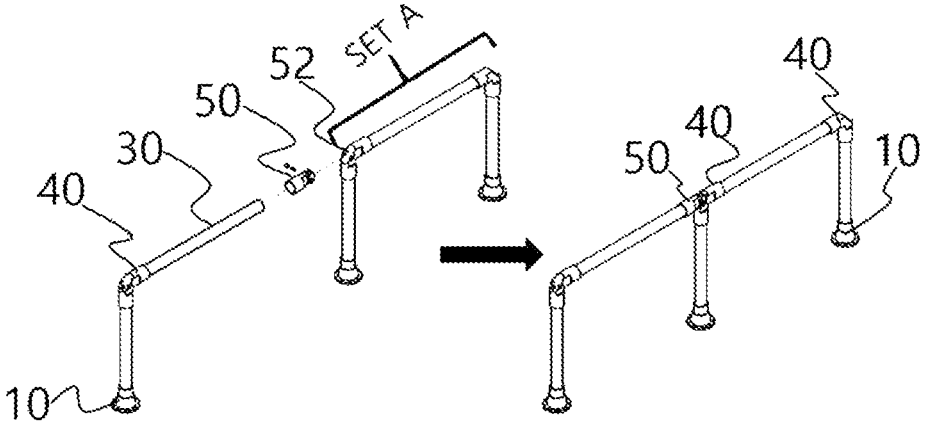
FIG. 7 is an embodiment view illustrating horizontal extension of the set A of the bollard fence.

Further, it is possible to horizontally extend a set of fences. As shown in FIG. 7, in order to horizontally extend a set of fences (set A), vertical poles can be coupled to the open grooves of two ground fixing members, respectively, the first ends of L-coupling members 40 are coupled to the upper portions of the vertical poles, a horizontal frame is installed between the second ends of the L-connecting members 40, whereby it is possible to assemble and manufacture a set of fences (set A). In this case, one ground fixing member and one vertical pole are additionally installed, the first end of an L-coupling member is coupled to the upper portion of the vertical pole, the second end of the L-connecting member is coupled to the first end of a horizontal frame to be added, the second end of the horizontal frame is coupled to a horizontal connecting member, and the second end of the horizontal connecting member is coupled to the fastening slope of the L-connecting member of the set of fences (set A). Accordingly, it is possible to horizontally extend a set of fences. That is, the lower end of vertical poles 20 are coupled to the opening grooves 11 of a plurality of ground fixing members, the coupling portions 51 of the first ends of L-connecting members 40 are coupled to the first ends of the vertical poles, respectively, and a horizontal frame 30 can be installed between the coupling portions 51 at the second ends of the L-connecting members. In order to horizontally extend this fence, the first end of an L-connecting member 40 is coupled to the first end of a horizontal frame, the first end of a horizontal connecting member 50 is coupled to the second end of the horizontal frame, and then the second end of the horizontal connecting member is coupled in surface contact to the fastening slope 52 of the set of fences A to which the L-connecting member is coupled, thereby being able to extend the set of fences.

Figure 9:
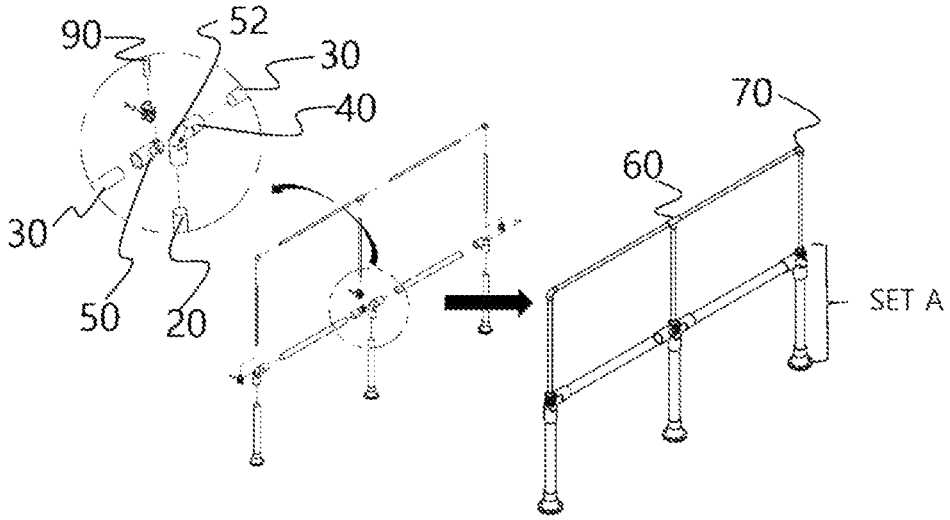
FIG. 9 is an embodiment view illustrating horizontal and vertical extension of the set A of the bollard fence.
Figure 10:
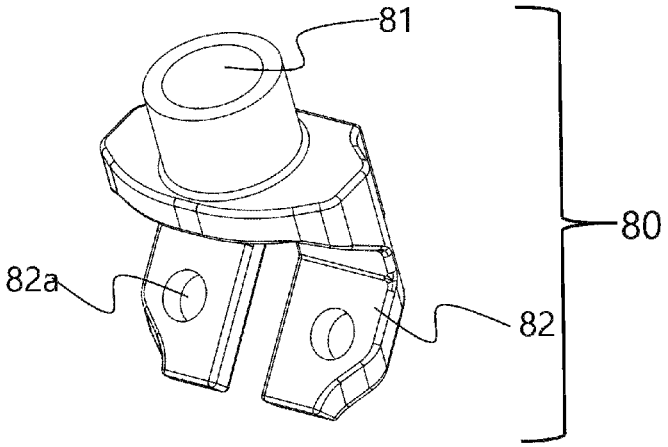
FIG. 10 is a detailed view of a two-stage connector that is used for the bollard fence.

Further, a horizontally extended fence can be additionally vertically extended. As shown in FIG. 9, in order to extend additionally vertically extend a horizontally extended fence, a two-stage connector 80 can be coupled to the fastening slope 52 of the L-connecting member of the horizontally extended fence using a fastener 140. In this case, the fastening portion 82 having the fastening through-hole 82*a* can be coupled in surface contact to the fastening slope 52 of the L-connecting member 40 using a fastener 140 and a sub-extension frame 90 can be vertically installed using the vertical extension coupling groove 81 at the upper portion thereof. When a sub-extension frame is horizontally installed between vertically installed sub-extension frames, a T-coupler 60 or an L-coupler 70 can be used, depending on the position. A T-coupler is used between two sub-extension frames that are horizontally installed and one sub-extension frame that are vertically installed, and an L-coupler is used is used to couple a sub-extension frame that is vertically installed and a sub-extension frame that is horizontally installed.

Two-stage connectors are coupled to the fastening slopes of L-connecting members, respectively, sub-extension frames are vertically installed in the vertical extension coupling grooves of the L-connecting members, L-couplers 70 are coupled to the upper ends of the sub-extension frames at both ends, and a T-coupler 60 is coupled to sub-extension frames that are horizontally installed between the sub-extension frames at both ends so that the fence can be horizontally and vertically extended, as in FIG. 9.

According to the present disclosure, it is possible to horizontally extend a fence using a ground fixing member, a vertical pole, an L-coupler, a horizontal coupler, and a horizontal frame.

In order to the horizontally extended fence in a multistage type, it is possible to vertically extend the frame additionally using two-stage connectors, sub-extension frames that are vertically and horizontally installed, and a T-coupler or an L-coupler.

Hereinabove, although the present disclosure is described by specific matters such as concrete components, and the like, embodiments, and drawings, they are provided only for assisting in the entire understanding of the present disclosure. Therefore, the present disclosure is not limited to the embodiments. Various modifications and changes may be made by those skilled in the art to which the present disclosure pertains from this description.

Therefore, the spirit of the present disclosure should not be limited to the described embodiments, and the following claims as well as all modified equally or equivalently to the claims are intended to fall within the disclosure.

What is claimed is:

1. A bollard fence that can be installed around a rack, the bollard fence comprising:

two ground fixing members having a ground supporting portion of a lower portion thereof for fixing on the ground and an open groove formed at an upper portion thereof;

two vertical poles of which lower ends are installed in the open grooves;

L-connecting members having two perpendiculars coupling portions and having a fastening slope between the two coupling portions;

a horizontal frame coupled between the L-connecting members;

two-stage connectors having a vertical extension coupling groove formed at an upper end thereof and having a fastening portion at a lower end thereof, at which a fastening through-hole is formed, to be coupled in surface contact with the fastening slope;

two sub-extension frames vertically coupled using the vertical extension coupling grooves;

two L-couplers of which first ends are coupled to upper ends of the two sub-extension frames; and one horizontal frame horizontally coupled between second ends of the L-couplers, the vertical poles can be coupled to the opening grooves of two ground fixing members, respectively, one ends of the L-connecting members are coupled to upper ends of the vertical poles, respectively, and the horizontal frame is installed between second ends of the L-connecting members, whereby a set of fences can be assembled and manufactured; and the two-stage connectors having the vertical extension coupling groove and the fastening portion can be fastened respectively to the fastening slopes of the L-connecting members, the fastening portions of the two-stage connectors having the fastening through-hole are coupled in surface contact with the surface contact slopes of the L-connecting members using fasteners, the sub-extension frames are vertically installed in the vertical extension coupling grooves of the two-stage connectors, first ends of the L-coupling members are coupled to upper ends of the vertically installed sub-extension frames, respectively, and one sub-extension frame is horizontally coupled to each of second ends of the L-coupling members, whereby the set of fences can be vertically extended.

2. The bollard fence of claim 1, comprising:

a plurality of ground fixing members additionally installed; a plurality of vertical poles installed on the plurality of ground fixing members; an L-connecting member of which a first end is coupled to an upper end of each of the additionally installed vertical poles; a horizontal frame of which a first end is coupled to a second end of the L-connecting member; a horizontal connector of which a first end is coupled to a second end of the horizontal frame;

a two-stage connector having a vertical extension coupling groove formed at an upper end thereof and having a fastening portion at a lower end thereof, at which a fastening through-hole is formed, to be coupled in surface contact with the fastening slope of the L-connecting member;

a plurality of sub-extension frames vertically coupled using the vertical extension coupling grooves;

two L-couplers of which first ends are coupled to upper ends of the sub-extension frames at both ends;

a T-coupler coupled between a sub-extension frame vertically installed at the middle; and a sub-extension frame horizontally coupled between a second end of the L-coupler and the T-coupler, wherein a second end of the horizontal connector is coupled to the fastening slope of the set of fences (set A), whereby a set of fences can be horizontally and vertically extended.

* * * * *